US005842954A

United States Patent [19]

Slupskiy

[11] Patent Number: 5,842,954

[45] Date of Patent: Dec. 1, 1998

[54] JUMP TRAINING DEVICE

[76] Inventor: Lentiy Slupskiy, 240 Mt. Vernon, Newark, N.J. 07106

[21] Appl. No.: 602,061

[22] Filed: Feb. 15, 1996

[51] Int. Cl.[6] ..... A63B 5/16

[52] U.S. Cl. ..... 482/15; 482/42; 482/81; 473/440

[58] Field of Search ..... 482/14–17, 41, 482/42, 111, 148, 81, 82, 36; 473/440, 422, 449, 447, 124, 101; 434/247, 248, 250, 251, 255, 258; 182/137, 138, 194, 196, 228

[56] References Cited

U.S. PATENT DOCUMENTS

| | | | |
|---|---|---|---|
| 201,328 | 3/1878 | Chamberlin | 482/17 |
| 662,810 | 11/1900 | Peak | 482/17 |
| 3,107,091 | 10/1963 | Jenkins | 482/17 |
| 3,172,660 | 3/1965 | Wallace et al. | 482/82 |
| 3,255,115 | 6/1966 | Peterson | 482/148 |
| 3,384,367 | 5/1968 | Baum | 482/17 |
| 3,578,323 | 5/1971 | Coleman et al. | 473/440 |
| 4,134,586 | 1/1979 | King | 473/440 |
| 4,783,070 | 11/1988 | Bauer et al. | 434/247 |
| 4,892,302 | 1/1990 | Daigle | 482/15 |
| 5,005,828 | 4/1991 | Sauerbrey | 482/17 |

FOREIGN PATENT DOCUMENTS

| | | | |
|---|---|---|---|
| 2353 | 4/1900 | Germany | 482/17 |
| 174832 | 9/1906 | Germany | 482/17 |
| 2250418 | 4/1974 | Germany | 482/82 |
| 2819398 | 11/1979 | Germany | 482/17 |

OTHER PUBLICATIONS

Acceleration Ladder, M–F Athletic Company, Perform Better 1995 catalog, p. 8, 1994.

*Primary Examiner*—Richard J. Apley
*Assistant Examiner*—Victor K. Hwang
*Attorney, Agent, or Firm*—Ilya Zborovsky

[57] ABSTRACT

A jump training device has a substantially ladder-like element including two longitudinal bar members spaced from one another in a transverse direction, and a plurality of transverse members connected to the longitudinal members movably movable in a longitudinal direction, each of the transverse members being yieldable so that when an athlete jumping over the transverse members touches a transverse member, the transverse member yields so as to prevent injury to the athlete.

2 Claims, 1 Drawing Sheet

JUMP TRAINING DEVICE

BACKGROUND OF THE INVENTION

The present invention relates to a jump training device for plyometric exercises (exercises that enable a muscle to reach maximum strength in as short a time as possible, for example involving jumping) which are used for development of speed-power skills and movement force of a jump for volleyball, basketball and football players, track and field events and others.

Various devices are used for these exercises such as well known gymnastic benches, boxes, cones or bags, elastic cords, etc., as well as special attachments and training devices. In particular power hurdles are also utilized, which provide the possibility of regulation of the degree of muscle stress by adjusting the height of the hurdles. This is especially important for training of the beginners. However, these training devices as well as other devices listed hereinabove, do not provide a complete safety for preventing traumas and injuries of athletes. Even modern models of the hurdles which break when stricken by a leg, do not eliminate the feeling of fear since the athlete can fall or land on individual parts of the broken hurdle with dangerous consequences. It is to be understood that such devices do not provide adequate emotional background for training, and do not contribute its mass utilization which is extremely important for the physical development of especially young people.

The use of elastic rubber cords which seems to be relatively efficient and also safe is also not satisfactory. When the rubber cords are mounted on the immovable supports, they again become dangerous when the athlete engages them and falls on them. If however the rubber cords are not attached to the supports at a certain level, it is necessary to use the efforts of many people and the support does not provide the required control of muscle stress. The use of jump boxes can be recommended only for highly skilled athletes and used as a rule for in-depth jumps, which needs very good preliminary preparations.

SUMMARY OF THE INVENTION

Accordingly, it is an object of the present invention to provide a jump training device which avoids the disadvantages of the prior art.

In keeping with these objects and with others which will become apparent hereinafter, one feature of the present invention resides, briefly stated, in a jump training device which has substantially horizontally arranged ladder-like element including two elongated side members spaced from one another in a transverse direction, and a plurality of transverse members which are connected with the elongated side members and are yieldable under the action of an athlete who jumps over the transverse members and during a jump touches the transverse members.

In accordance with one embodiment of the present invention, each transverse member can be composed of two parts which are yieldably connected with one another and particularly releasably connected with one another, for example by a VELCRO (hooks and loops) connection. In this construction, when the athlete accidentally touches the transverse member, its parts are separated from one another.

In accordance with another embodiment of the present invention, the transverse members are formed as elongated elastic cords which are stretched when the athlete touches the transverse members during jumps.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
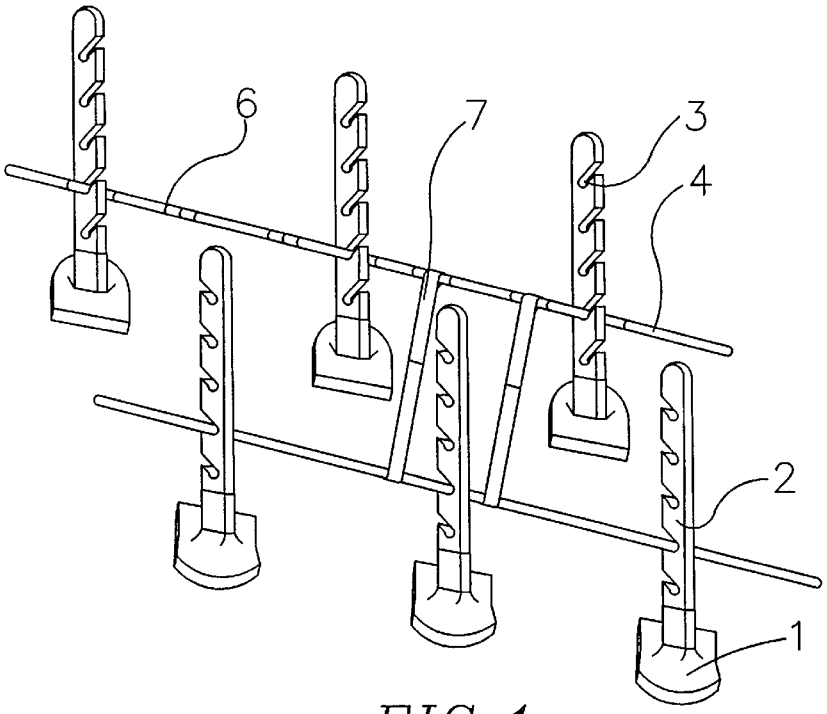
FIG. 1 is a perspective view showing a jump training device in accordance with the present invention.
Figure 3:
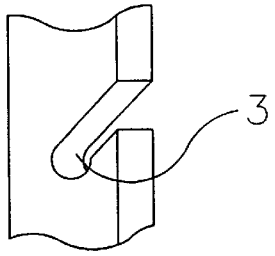
FIG. 3 is a view showing a fragment of a vertical support provided with a slot of the inventive training device.
Figure 2:
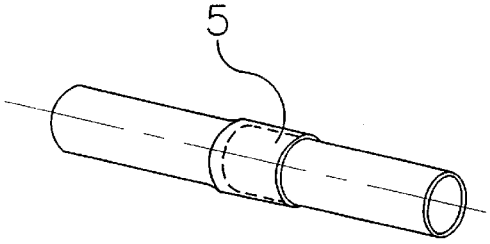
FIG. 2 is a view showing a connection of two parts of an elongated side member of the inventive device.
Figure 4:
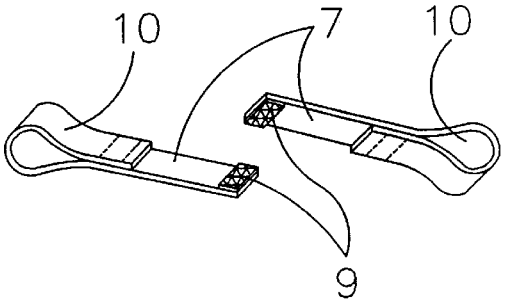
FIG. 4 is a view showing a transverse member of the inventive training device.

A jump training device in accordance with the first embodiment shown in FIG. 1 has a plurality of vertical standards 2 which are preferably composed of a plastic material and having a heavy lower base. The standards 2 are provided with lower rubber layers 1 and a plurality of slots 3 spaced from one another in a vertical direction. The standards 2 are arranged in two groups so that the standards of each group are spaced from one another in a longitudinal direction, and the groups of standards are spaced from one another in a transverse direction. The device further has a plurality of plastic or metal bars 4. Each of the bars can be assembled of a plurality of parts by feeding an expanded end 5 of one part onto a standard end of the other part as shown in FIG. 2. The bars 4 have a plurality of lines 6 which are spaced in the longitudinal direction. The lines can have different colors. For example each bar can have a plurality of green lines spaced from one another by the distances equal to 0.4 m, a plurality of yellow lines spaced from one another by the distances of 0.5 m, a plurality of red lines spaced from one another by the distances of 0.6 m.

The device has a plurality of transverse members which are identified as a whole with reference numeral 7. The transverse members 7 are composed of fabric, for example from soft synthetic fabric. Each transverse member 7 has two loops 10 at both its ends for attachment to the bars 4. Each of the transverse members 7 is composed of two parts which are releasably connectable with one another in the middle of the transverse member for example by a VELCRO connection 9.

The jump training device operates in the following manner. The standards 2 are arranged in groups which are transversely spaced from one another, and the bars 4 together with the transverse members 7 are inserted into the slots 3 of the standards 2. The transverse members 7 are arranged so as to be spaced from one another by desired distances, by means of the color lines 6.

In order to train himself in jumping, an athlete stands in front of the first transverse member 7, then pushes himself from the floor and jumps over the first transverse member. When he lands, he tries to immediately push from the ground again without delay for a subsequent jump, etc. In order to increase the muscle 102*d* of training, the bars with the transverse members can be arranged at different heights.

If the athlete touches the transverse member 7, the VELCRO connection is immediately disengaged, and the parts of the transverse member 7 just fall down, whereby any injury to the athlete is prevented.

Figure 5:
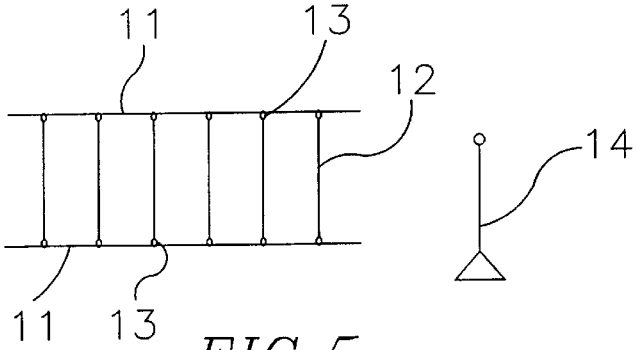
FIG. 5 is a view showing a further embodiment of the inventive jump training device.

FIG. 5 shows another embodiment of the present invention. Here the transverse bars are replaced with two ropes 11 spaced from one another in a transverse direction and connected with one another by transverse members 12 which are composed of elastic rubber bands or cords and connected to the ropes 11 by loops 13 which easily slide along the ropes. If desired, additional vertical standards 14 can be provided, so that the ropes 11 at both ends are connected to the vertical standards.

For exercising purposes, the device is held by two people at a desired height or can be attached with its ends to any objects, including the standards 14. The jump training is performed in the same manner. If during jumping the athlete touches the transverse members 12, they yield by stretching downwardly or longitudinally, to prevent any injury to the athlete.

It will be understood that each of the elements described above, or two or more together, may also find a useful application in other types of constructions differing from the types described above.

While the invention has been illustrated and described as embodied in a ladder-like jump training device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

I claim:

1. A jump training device, comprising a plurality of substantially vertical supports which are spaced from one another in a longitudinal direction and arranged in two rows spaced from one another in a transverse direction, each of said supports being provided with engaging formations spaced from one another in a vertical direction and each having a base which is heavier than a remaining portion of each of said supports; two longitudinal bar members spaced from one another in the transverse direction and each supported by said engaging formations of said supports of a respective one of said rows of said supports; a plurality of transverse members connected to said longitudinal members; means for connecting said transverse members to said longitudinal members so as to be movable relative to said longitudinal members in a longitudinal direction, each of said transverse members having two parts which are releasably connected with one another in a center of each of said transverse members so that when an athlete contacts one of said transverse members, said parts disengage from one another in the center of said transverse member, each of said transverse members having two ends provided with loops which form said means for connecting said transverse members to said longitudinal members, each of said loops having a diameter which is greater than a diameter of each of said longitudinal members.

2. A jump training device, comprising a plurality of substantially vertical supports which are spaced from one another in a longitudinal direction and arranged in two rows spaced from one another in a transverse direction, each of said supports being provided with engaging formations spaced from one another in a vertical direction and each having a base which is heavier than a remaining portion of each of said supports; two longitudinal bar members spaced from one another in the transverse direction and each supported by said engaging formations of said supports of a respective one of said rows of said supports; a plurality of transverse members connected to said longitudinal members; means for connecting said transverse members to said longitudinal members so as to be movable relative to said longitudinal members in a longitudinal direction, each of said transverse members having two parts which are releasably connected with one another in a center of each of said transverse members so that when an athlete contacts one of said transverse members, said parts disengage from one another in the center of said transverse member, and means for releasably connecting said parts of each of said transverse members with one another in the center and including a hooks and loops connection provided in the center of each of said transverse members, each of said transverse members having two ends provided with loops which form said means for connecting said transverse members to said longitudinal members, each of said loops having a diameter which is greater than a diameter of each of said longitudinal members.

* * * * *